United States Patent [19]

Als et al.

[11] Patent Number: 4,611,353

[45] Date of Patent: Sep. 16, 1986

[54] INFANT'S GARMENT

[75] Inventors: Heidelise Als, Brookline; Annie Zeybekoglu, Boston, both of Mass.

[73] Assignee: The Children's Medical Center Corporation, Boston, Mass.

[21] Appl. No.: 626,685

[22] Filed: Jul. 2, 1984

[51] Int. Cl.[4] ..... A41B 1/12

[52] U.S. Cl. ..... 2/69

[58] Field of Search ..... 2/69, 114

[56] References Cited

U.S. PATENT DOCUMENTS

| | | | |
|---|---|---|---|
| 2,008,919 | 7/1935 | Milkes | 2/69 |
| 2,227,751 | 2/1939 | Idelman | 2/84 |
| 2,459,352 | 1/1949 | Williams | 2/69 |
| 2,538,420 | 1/1951 | Junghans | 2/69 |
| 3,739,399 | 6/1973 | Sheahon | 2/69.5 |

FOREIGN PATENT DOCUMENTS

| | | | |
|---|---|---|---|
| 419055 | 1/1925 | Fed. Rep. of Germany | 2/69 |
| 210068 | 6/1940 | France | 2/114 |

*Primary Examiner*—Doris L. Troutman

[57] ABSTRACT

An infant's garment having a sack portion adapted to receive the legs of an infant, and two flaps attached to the sack adapted to wrap around the infant's arms and overlap behind the body.

8 Claims, 4 Drawing Figures

INFANT'S GARMENT

BACKGROUND OF THE INVENTION

The invention described herein was made in the course of work under a grant or award from the U.S. Government, and the Government therefore has rights in the invention.

This invention relates to garments for infants.

Various infant garments are described in the patent literature. For example, Sheahon U.S. Pat. No. 3,739,399 describes an infant's plastic insulating garment in which flaps enclose the infant, with its arms at its sides; Idelman U.S. Pat. No. 2,277,781 describes a hooded one-piece blanket which encloses an infant and permits movement of the arms within the closed blanket.

SUMMARY OF THE INVENTION

In general, the invention features an infant's garment including a sack portion adapted to receive the legs of an infant, and two flaps attached to the sack portion adapted to wrap around the infant's arms and overlap around the infant's body.

In preferred embodiments, the garment further includes, at the bottom of the sack portion, soft, flexible means for interfacing with the soles of the feet of the infant, the soft means being sufficiently thick and resilient to enable the infant to dig in its toes; the garment further includes a hood having elastic gathers at the neck region, an elastic mid-line band forming gathers in the upper front portion of the sack portion, and means for fastening the arm flaps to the back portion of the garment or to each other at the back of the garment.

In another preferred embodiment, the flaps are sufficiently long and pliable to remain in position behind the infant without fasteners.

The garment of the invention, because of its long, pliable flaps, gently binds an infant's arms in a bent-elbow, hands-up position. This feature makes the garment very useful for holding a premature infant, since the garment inhibits the tendency of the premature infant to fling open its arms, without restricting arm movement altogether. The flaps and hood provide warmth, while the sack portion permits movement of the infant's legs while retaining body heat. The soft flexible means at the bottom of the sack provides an outlet for the infant's kinetic energy and permits it to follow its natural tendency to grasp with its toes.

Other features and advantages of the invention will be apparent from the following description of the preferred embodiment, and from the claims.

DESCRIPTION OF THE PREFERRED EMBODIMENT

We first briefly describe the drawings.

DRAWINGS

STRUCTURE AND OPERATION

Figure 1:
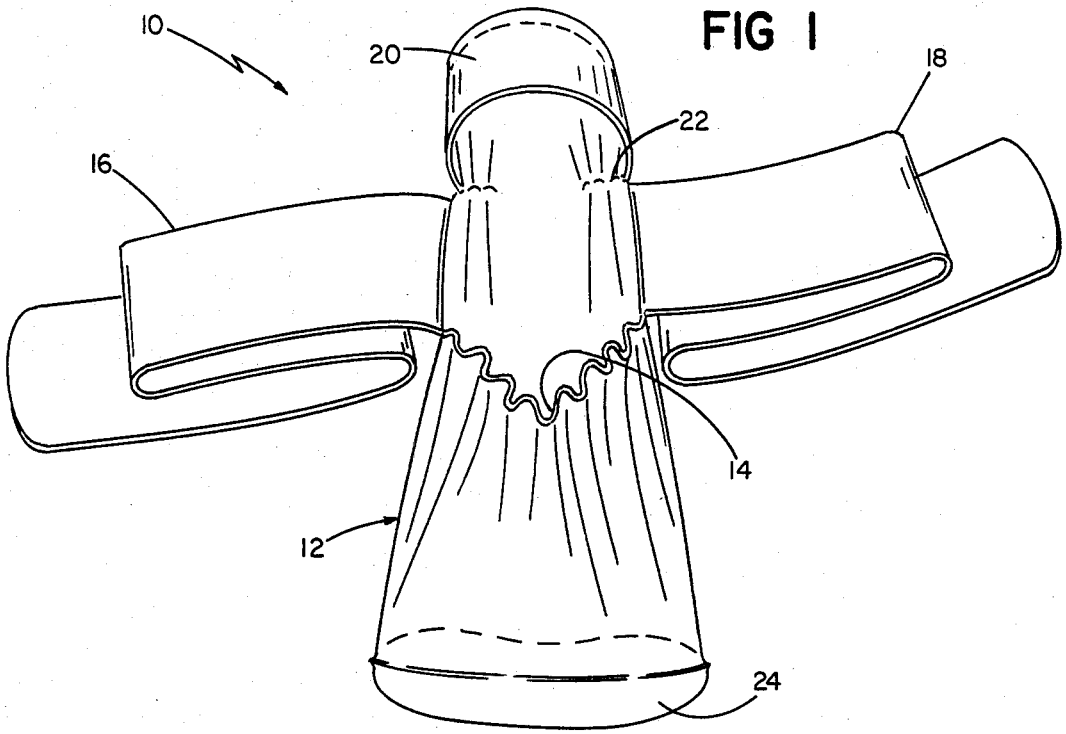
FIG. 1 is an isometric view of a preferred garment.

Referring to FIG. 1, infant's garment 10 includes sack portion 12 fitted with elastic band 14, overlapping arm flaps 16 and 18, a hood 20 with gathers formed by elastic band 22, and a cylinder of soft, resilient material 24 secured at the bottom of sack 12. Each arm flap is 15 to 30, most preferably 25.5, inches long and 2 to 6, most preferably 4, inches wide; the sack portion is 7 to 13, most preferably 10, inches long and 7 to 13, most preferably 10, inches wide at its widest point; and the hood is about 4.5 inches high. The length of the arm flaps permits them to wrap around the infant and meet at the back, where they will remain without fasteners. Alternatively, fastening means, e.g., velcro strips on the arm flaps or on the back of the sack can be provided, to ensure that the flaps remain secure around the infant. (Fastening means are not shown.)

Figure 2:
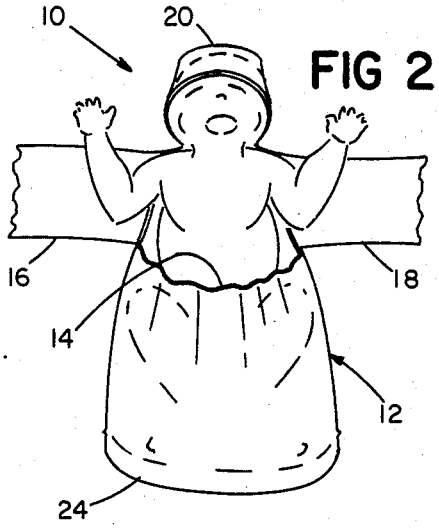
FIG. 2 is an isometric view of the garment showing placement of an infant in the garment.
Figure 3:
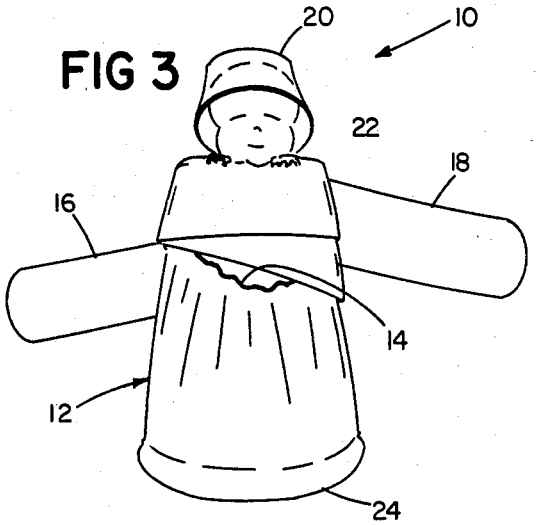
FIG. 3 is an isometric view of the garment in use.
Figure 4:
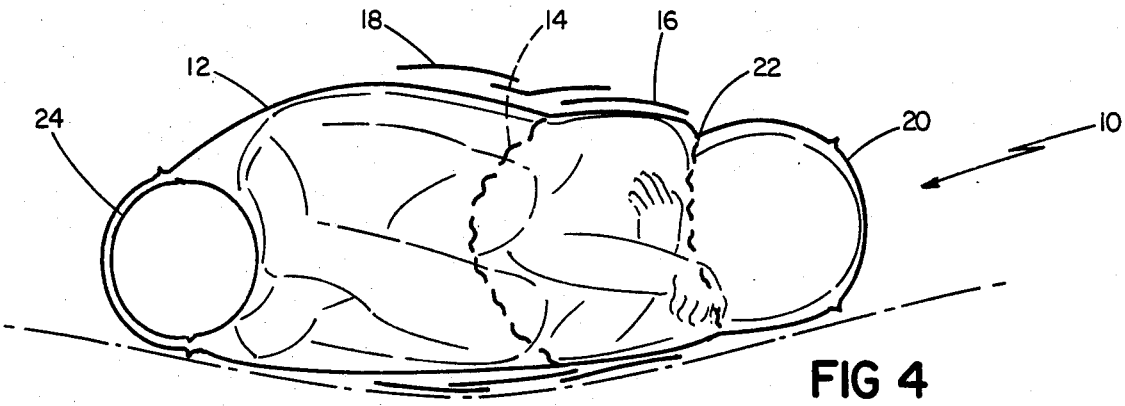
FIG. 4 is a plan view, partially broken away, of the garment is use.

To use the garment, an infant is placed with its lower body in sack portion 12 and its head in hood 20, as shown in FIG. 2. Arm flaps 16 and 30 are then wrapped around the infant so that they overlap in the back, thus constraining the infant's arms to remain in a bent-elbow, hands-up position as illustrated in FIG. 3. Once in the garment, the infant's feet grasp at cylinder 24, while its hands clutch arm flaps 16 and 30, as shown in FIG. 4. The garment thus keeps the infant warm and allows some movement while restricting undesirable movements.

Other embodiments are within the following claims.

We claim:

1. An infant's garment comprising a sack portion adapted to receive the legs of an infant and having a left and right side, and two elongated, pliable flaps attached to said sack portion and extending from the left and right sides of said sack portion at locations permitting them to wrap around and gently bind the infant's arms, said flaps being sufficiently long to overlap behind the body of said infant.

2. The garment of claim 1, further comprising, at the bottom of said sack portion, soft, flexible means for interfacing with the soles of the feet of the infant, said means being sufficiently thick and resilient to enable said infant to dig its toes into said means.

3. The garment of claim 1, further comprising a hood having elastic gathers at the neck region.

4. The garment of claim 1 wherein said flaps are made of fabric sufficiently pliable to remain in position without fasteners.

5. The garment of claim 1, further comprising an elastic mid-line band forming gathers in the upper front portion of said sack portion.

6. The garment of claim 1, further comprising means for fastening said arm flaps to the back portion of said garment or to each other at the back of said garment.

7. The garment of claim 1 wherein each said arm flap is 15 to 30 inches long.

8. The garment of claim 2 wherein said flaps are made of fabric sufficiently pliable to remain in position without fasteners, and further comprising an elastic mid-line band forming gathers in the upper front portion of said sack portion.

* * * * *